US007278213B2

(12) United States Patent
Pardue et al.

(10) Patent No.: US 7,278,213 B2
(45) Date of Patent: Oct. 9, 2007

(54) HAND TOOL STOP PIN

(75) Inventors: Melvin Pardue, Repton, AL (US); Steven Ingram, Portland, OR (US)

(73) Assignee: Mentor Group, L.L.C., Oregon City, OR (US)

( * ) Notice: Subject to any disclaimer, the term of this patent is extended or adjusted under 35 U.S.C. 154(b) by 323 days.

(21) Appl. No.: 10/820,360

(22) Filed: Apr. 7, 2004

(65) Prior Publication Data

US 2005/0223562 A1 Oct. 13, 2005

(51) Int. Cl.
*B26B 1/04* (2006.01)

(52) U.S. Cl. ..... 30/160; 30/159; 30/161

(58) Field of Classification Search ..... 30/151–164, 30/137, 342; 7/118, 168, 128, 129; 81/319, 81/440, 427.5, 117.4; 151/160, 185; 411/410, 411/427, 429, 216, 395, 389; 403/200, 330, 403/150, 408.1, DIG. 8; 292/137, 175
See application file for complete search history.

(56) References Cited

U.S. PATENT DOCUMENTS 2,483,660 A * 10/1949 Morris et al. ..... 65/171
3,418,010 A * 12/1968 Buckner ..... 285/92
4,427,326 A * 1/1984 Hobson et al. ..... 411/5
4,541,175 A * 9/1985 Boyd et al. ..... 30/161
5,331,741 A * 7/1994 Taylor, Jr. ..... 30/158
5,722,168 A * 3/1998 Huang ..... 30/161
5,794,346 A * 8/1998 Seber et al. ..... 30/161
5,822,866 A 10/1998 Pardue
5,964,035 A * 10/1999 Poehlmann ..... 30/161
6,115,921 A * 9/2000 Garneau, Sr. ..... 30/123
6,276,063 B1 * 8/2001 Chen ..... 30/161
6,406,240 B1 * 6/2002 Potter ..... 411/433
6,516,525 B2 * 2/2003 Liu ..... 30/519
6,953,313 B2 * 10/2005 Tylosky ..... 411/389
2001/0016987 A1 * 8/2001 Chen ..... 30/161
2002/0104220 A1 * 8/2002 Marfione ..... 30/160
2004/0158991 A1 * 8/2004 Freeman ..... 30/161
2005/0198825 A1 * 9/2005 Apprille, Jr. ..... 30/40.2
2005/0217120 A1 * 10/2005 Proulx ..... 30/276

OTHER PUBLICATIONS

Affidavit of Melvin Pardue.

* cited by examiner

*Primary Examiner*—Boyer D. Ashley
*Assistant Examiner*—Laura M. Lee
(74) *Attorney, Agent, or Firm*—Hancock Hughey LLP

(57) ABSTRACT

A hand tool such as a folding knife that incorporates a blade stop pin that stops rotation of the blade in the open position is described. The stop pin defines a multifaceted face having plural surfaces, each having a radial distance from an axial centerline that is different from adjacent surfaces. Rotation of the stop pin allows for adjustment of the stop position of the blade.

8 Claims, 8 Drawing Sheets

HAND TOOL STOP PIN

FIELD OF THE INVENTION

This invention relates to hand tools such as knives and multitools that incorporate folding implements, and more specifically to a stop pin for use in such tools that facilitates adjustment of implement stop position.

BACKGROUND

Many types of hand tools such as knives and multitools incorporate folding mechanisms that allow an implement to be moved between a folded position in which the implement is safely stowed in the tool handle, and an extended position in which the implement is ready for work. One typical example of such a folding tool is a knife having a folding blade. The knife handle typically has two opposed handle portions defining a blade-receiving groove. A blade pivots on a shaft attached to the handle such that in a folded position the blade is stowed with the cutting portion of the blade safely in the groove, and such that in an extended position the blade is extended away from the handle, ready for use. Foldable knives are ubiquitous.

To increase the safety of folding tools such as knives, many such tools incorporate locking mechanisms of one type or another. When the knife blade pivots into the open position, it's pivotal movement is stopped with a transverse blade stop pin housed in the handle. Often a locking mechanism is included that prevents the blade from pivoting back from the open into the closed position. There are many types of locking mechanisms. One common type is a "liner lock." This kind of mechanism relies upon a resilient lever formed as part of a handle liner. When the blade is pivoted to the open or extended position, the resilient lever engages a cooperatively formed ramp on the blade and thereby locks the blade in the open position. Another typical locking mechanism is a cross-bolt mechanism such as that described in U.S. Pat. No. 5,822,866. As detailed in the '866 patent, which describes an automatic opening knife, the cross-bolt mechanism includes a locking body that has a cylindrically tapered side wall portion. When the blade is extended to the open position, the tapered side wall portion of the locking body is urged by a compression spring into a locking position in which the locking body wedges between an engagement surface on the blade and a bore in the handle to lock the blade in the open position. Both types of knives just described—the liner locking type and the cross-bolt type—and many other knives, rely on a blade stop pin to stop blade rotation in the opening direction. The stop pin is a cylindrical rod that typically abuts a shoulder formed on the blade at the same time the lock mechanism engages.

Most folding knives, including those that use liner locks and those described in the '866 patent are manufactured according to strict manufacturing tolerances. Often these tolerances mandate that there are cumulatively only a few thousandths of an inch tolerance in the assembled product. This means that when manufacturing the numerous parts for a knife, each part has to be within even smaller tolerances for the finished product to meet cumulative specifications. Unfortunately, manufacturing tolerances are not always easily controlled. In a folding knife, out of tolerance or near tolerance parts can add up in the finished product and result in an assembled product that does not meet final quality specifications and does not operate properly.

In the example of a folding knife that uses a stop pin and a locking mechanism, if the assembled product is out of specification, the locking mechanism may not engage properly. To remedy this situation, the unit must be repaired to adjust the locking mechanism so it works properly and to bring it within acceptable specifications. With liner lock knives and cross-bolt knives that use stop pins, this requires that the knife is disassembled and one or more parts replaced or repaired by milling to bring the part or the assembled product within acceptable specification ranges. For example, with a liner lock the liner lever may need to be milled, or the ramp portion of the blade may be milled, or the liner may need to be replaced. With a cross-bolt type of lock, the tapered portion of the locking body and/or the handle may need to be milled. In both cases, the stop pin may also be milled. But regardless of the process that is used to adjust the blade locking mechanism, disassembly, milling and repair and reassembly are time consuming and expensive.

There is a need therefore for an apparatus that allows adjustment of the implement stop position in a folding tool that incorporates an implement stop pin.

The present invention relates to a hand tool handle that incorporates a mechanism for variably adjustment of the stop position of the implement when it is in the open position.

BRIEF DESCRIPTION OF THE DRAWINGS

The invention will be better understood and its numerous objects and advantages will be apparent by reference to the following detailed description of the invention when taken in conjunction with the following drawings.

In FIG. 1 the knife blade is shown in the open position.

DETAILED DESCRIPTION OF THE PREFERRED EMBODIMENTS

A preferred embodiment of a hand tool 10 incorporating an implement stop pin in accordance with the illustrated invention is shown in the figures. Although the invention is described with respect to a particular type of tool—a knife—and even then a particular type of knife—a folding knife having an automatic opening mechanism—it will be appreciated that references to this type of a knife, and indeed this particular type of hand tool, are for illustrative purposes to describe the invention. Those of ordinary skill in the art will appreciate that the invention claimed herein is not limited to knives, but instead extends to any hand tool having the features claimed herein.

Figure 1:
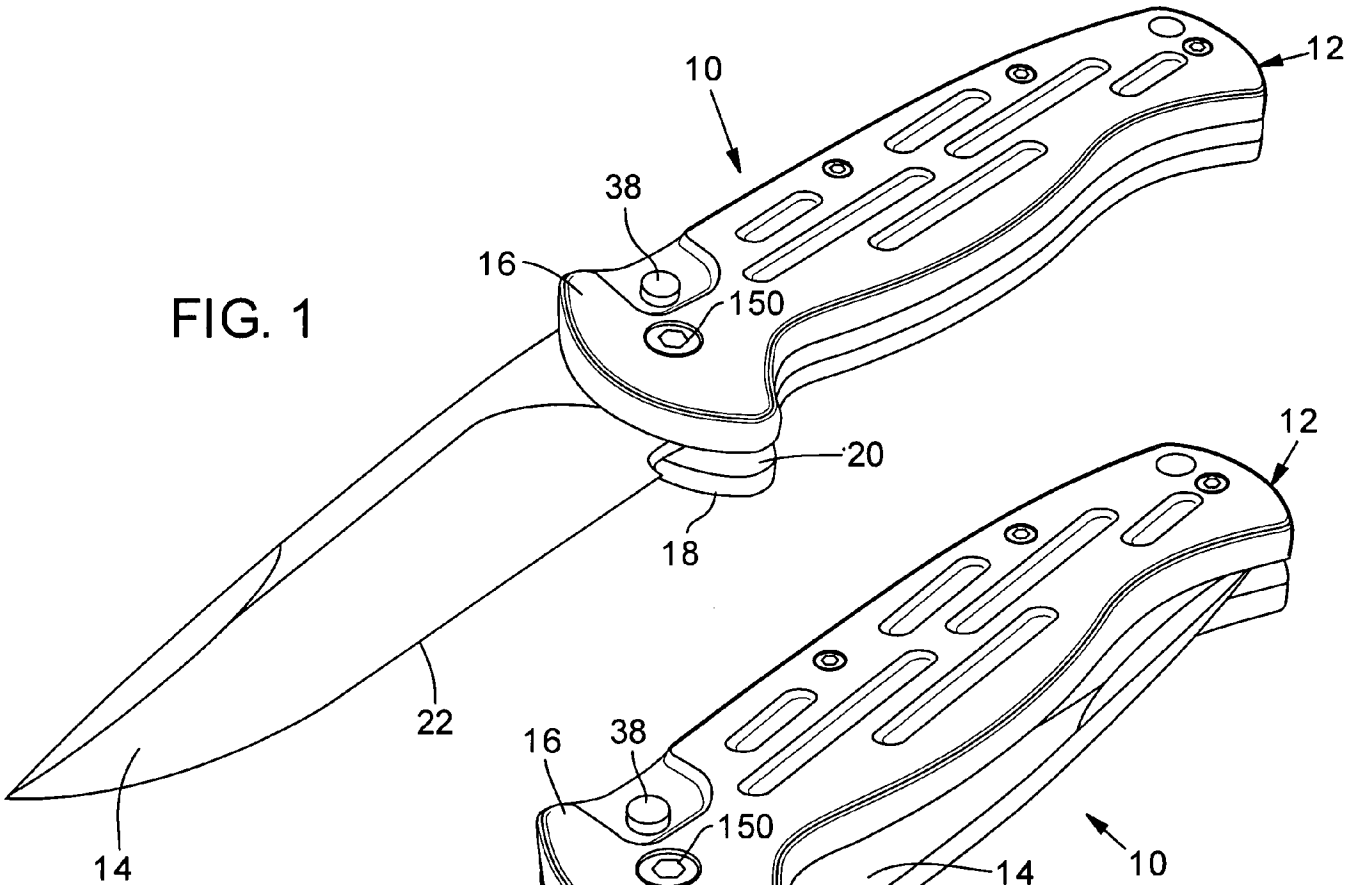
FIG. 1 is a perspective view of a hand tool—in this case a folding knife—that is exemplary of the type of hand tool that incorporates a blade stop pin in accordance with the illustrated invention.
Figure 2:
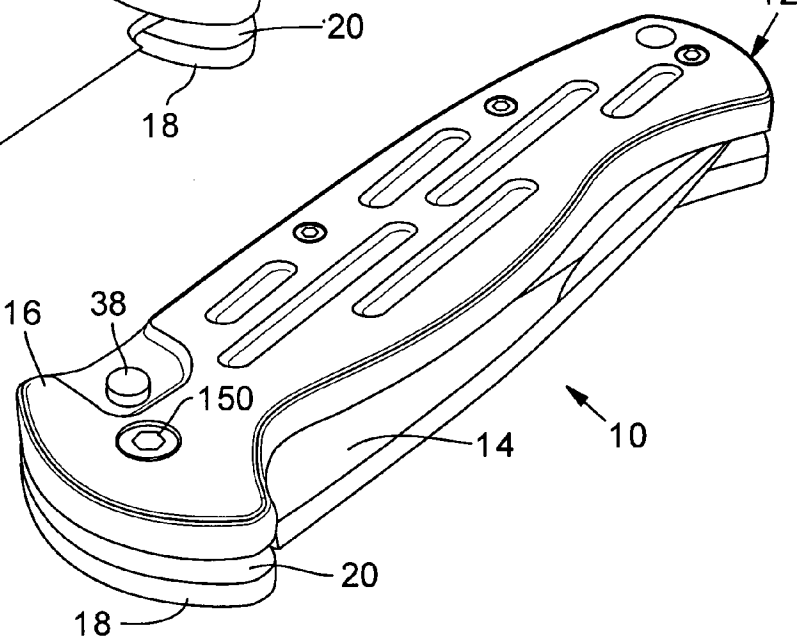
FIG. 2 is a perspective view of the knife shown in FIG. 1 with the blade stowed in the closed position.
Figure 3:
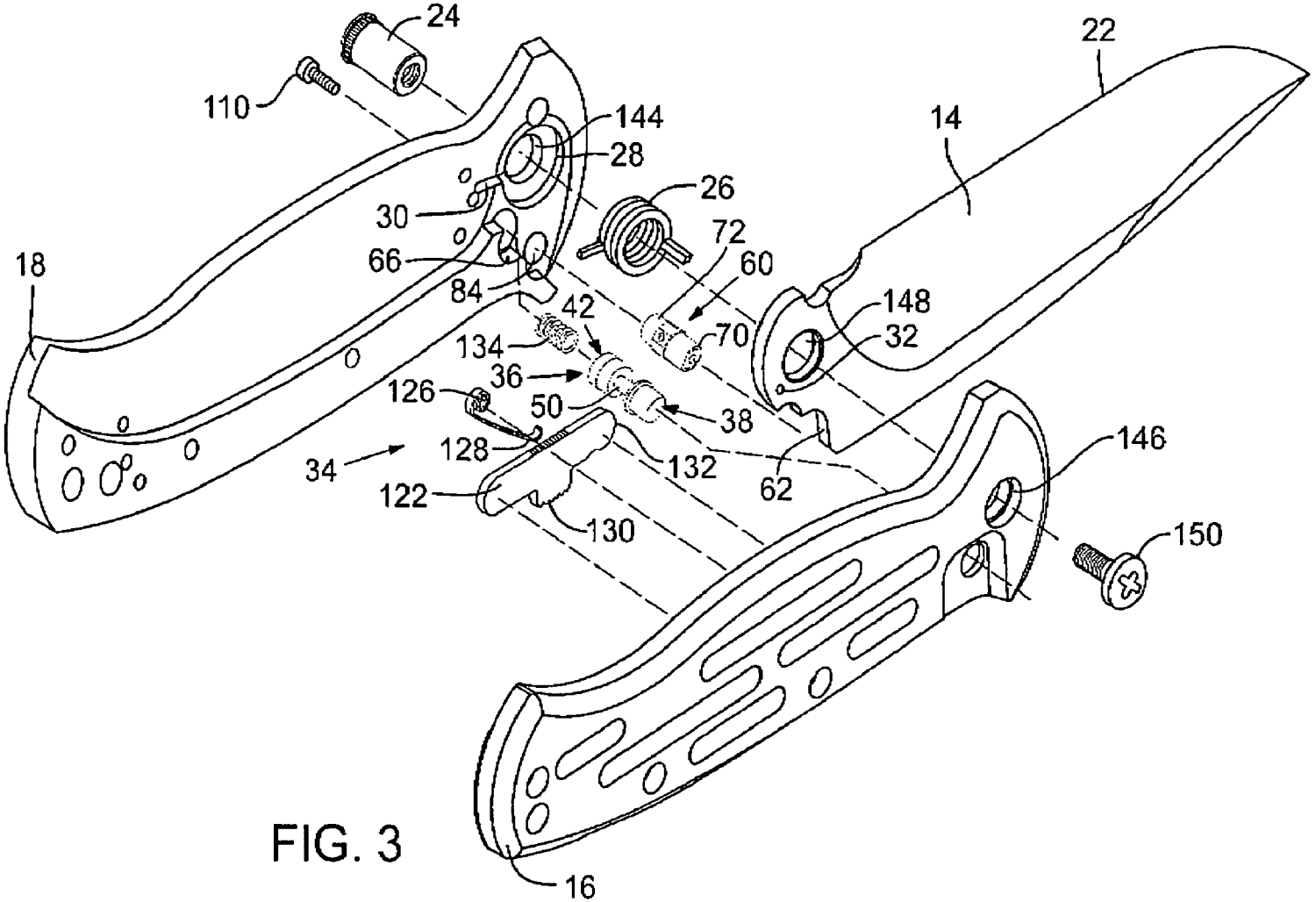
FIG. 3 is an exploded perspective view of the knife shown in FIG. 1, illustrating some of the component parts.

With reference to FIGS. 1 through 3, knife 10 includes a handle 12 and a blade 14. Handle 12 includes two side wall portions or halves 16 and 18 that are held parallel to one another in a spaced apart relationship with various screws and the like to define a blade receiving groove 20 therebetween. Blade 14 is pivotally attached to handle 12 with a pivot shaft 24 that has its opposite ends fixed to the handle halves. When the blade 14 is in the retracted or closed position shown in FIG. 2, the working or sharp portion 22 of the blade is safely stowed in groove 20.

The knife 10 shown in the figures includes an automatic opener mechanism of the type described in U.S. Pat. No. 5,822,866, which is owned by the assignee of the present application and which is incorporated herein by this reference. Preferably, an automatic opening knife of the type shown in the figures includes a safety mechanism that prevents unintentional activation of the automatic opener mechanism. Although a safety mechanism is not shown in FIGS. 1-13, it will be understood that a knife 10 as shown herein that includes an automatic opener preferably includes a safety mechanism.

Figure 4:
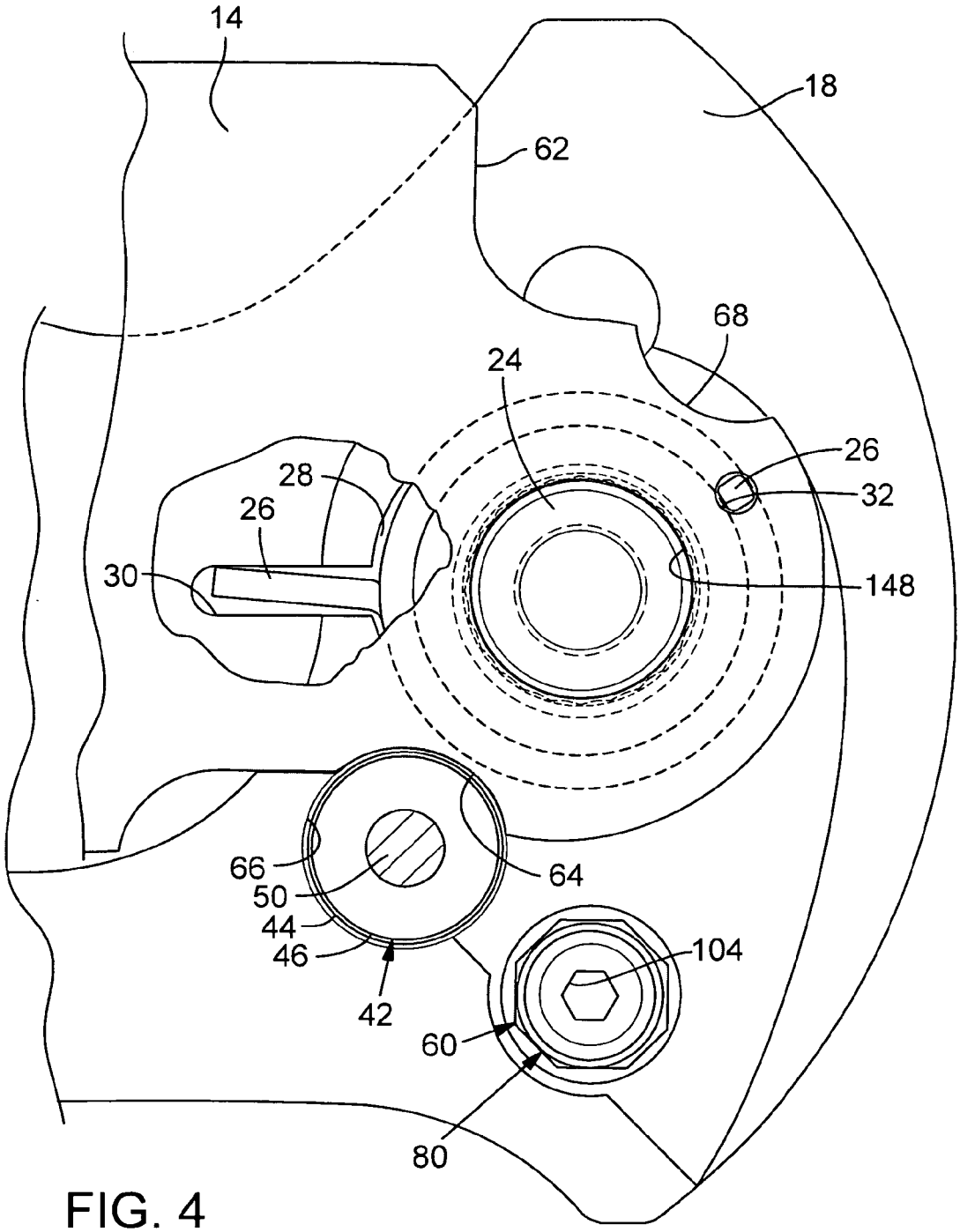
FIG. 4 is a close up, partial sectional and partially cut away view of the knife shown in FIG. 1 with the blade in the closed position and illustrating a blade stop pin formed in accordance with the illustrated invention.

With reference now to FIGS. 3 and 4, the automatic opener incorporated in knife 10 is defined by a wire spring 26 that is housed in a recess 28 formed in handle half 18. Spring 26 extends around shaft 24 and has one end fixed in a slot 30 in handle half 18, and the opposite end inserted into a bore 32 in blade 14. During assembly of the knife, spring 26 is wound so that it provides an opening elastic force for urging blade 14 toward the open position.

The automatic opener mechanism is operated with a trigger mechanism, generally referenced herein with number 34, which is fully described in the '866 patent. By way of background, trigger mechanism 34 includes a cross bolt that is spring-loaded and extends in a transverse direction between handle halves 16 and 18, parallel to shaft 24. The cross bolt 36 is shown in isolation in FIG. 7 and comprises a button end 38 that is operable by a user to open the knife. A flange 40 extends radially around the base of the button end 38 of cross bolt 36 and functions to retain the cross bolt housed in the assembled knife. The end of cross bolt 36 opposite of button end 38 defines a locking body 42 which has a relatively large diameter portion 44 and a tapered sidewall portion 46. In the assembled knife, the large diameter portion 44 is received in a cavity formed in handle half 18 and a compression spring 134 (FIG. 15) is received in a hollow base 48 formed in locking body 42. A shank 50 interconnects button end 38 to locking body 42.

Operation of the automatic opener is now briefly described. When blade 14 is in the closed position shown in FIG. 2, cross bolt 36 operates to lock the blade and retain it in this position. With reference to FIG. 4, the blade 14 is locked in this closed position by the tapered sidewall portion 46 of locking body 42, which wedges between and engages a first locking surface on blade 14 defined by a notch 64, and a cooperatively formed locking surface on handle 18 defined by a notch 66. The blade is held in this closed position (again, preferably with a safety mechanism) until the trigger 34 is activated.

Figure 5:
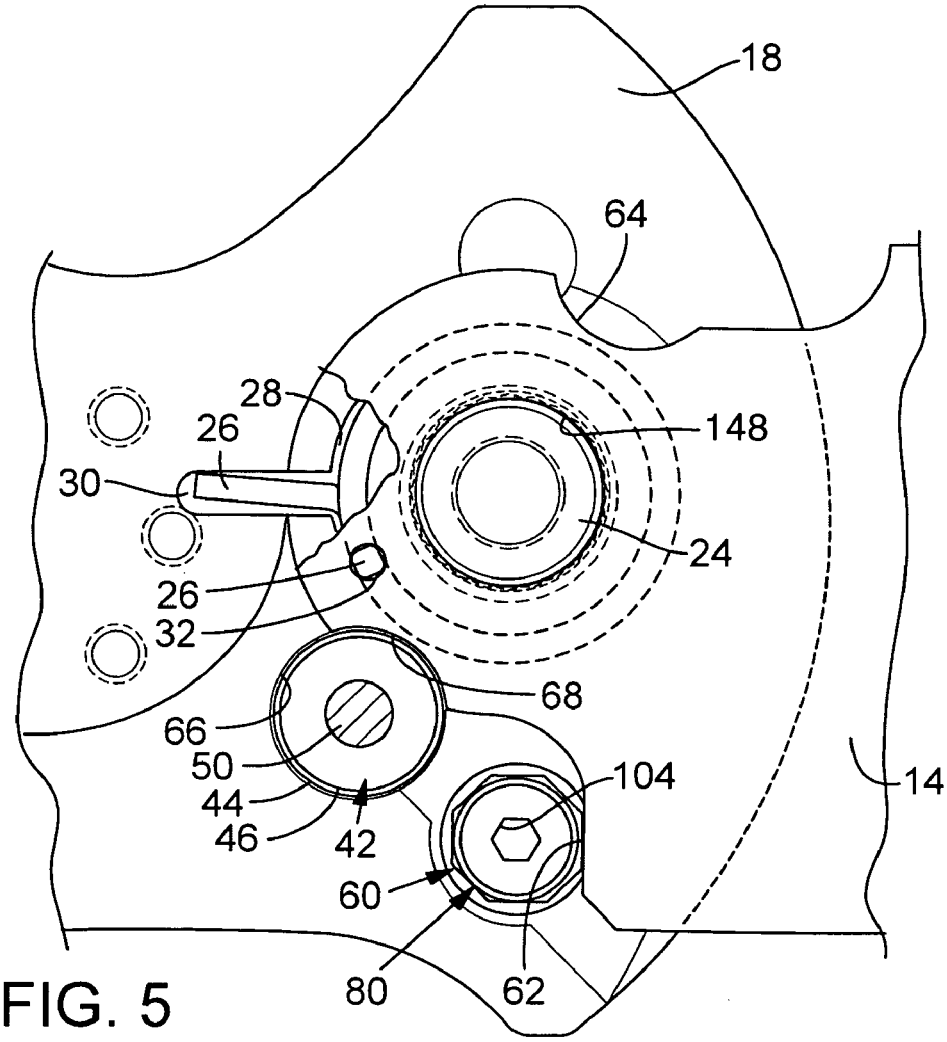
FIG. 5 is a close up, partial sectional and partially cut away view similar to the view of FIG. 4 but with the blade in the open position and illustrating a blade stop pin formed in accordance with the illustrated invention.

Operation of trigger 34 is accomplished by pushing button end 38 of cross bolt 36 inwardly against the force of the compression spring described above. This causes the locking body to disengage the notch 64. When this happens, blade 14 is pivotally driven toward the open position by the force of spring 26. Rotation of blade 14 as it moves from the closed position to the open position is stopped with a blade stop pin 60 that extends parallel to pivot shaft 24 and which has its opposite ends fixed in the handle halves 16 and 18, respectively. The stop pin 60 is described in greater detail below. When the blade 14 is in the open position shown in FIG. 1, a shoulder 62 formed on blade 14 abuts stop pin 60 to thereby stop rotational movement of blade 14. This is best shown in FIG. 5. The position of blade 14 when shoulder 62 abuts stop pin 60 is defined as the stop position—that is, the fully open position. In a knife 10 that incorporates a locking mechanism as described above, when shoulder 62 abuts stop pin 60 the blade 14 is locked in this open position by the action of cross bolt 36. Specifically, under the force of the compression spring, the tapered sidewall portion 46 of locking body 42 wedges between and engages a second locking surface on blade 14 defined by a notch 68, and a cooperatively formed locking surface on handle 18 defined by a notch 66.

Figure 6:
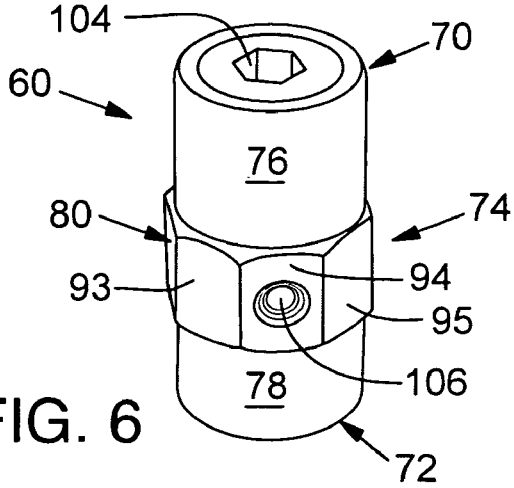
FIG. 6 is a perspective view of the blade stop pin according to the illustrated invention.
Figure 7:
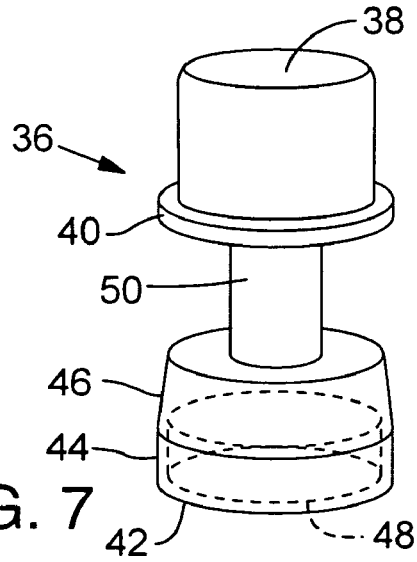
FIG. 7 is a perspective view of the cross-bolt pin used in the knife shown in FIG. 1.

Having described knife 10 and the automatic opener mechanism in a general manner, attention will now be turned to the stop pin 60. Referring to FIG. 6, stop pin 60 comprises generally an elongate body having a first end 70, and opposite second end 72, and a central portion 74. The outer surface of stop pin 60 adjacent first end 70 is defined by a cylindrical surface 76, and the outer surface at second end 72 is defined by a cylindrical surface 78. The outer surface of stop pin 60 at central portion 74 is defined by a multi-faceted surface identified generally with reference number 80 that is defined by plural planar sections. Returning to FIG. 3, stop pin 60 is housed in handle halves 16 and 18 in the assembled knife. More particularly, first end 70 of stop pin 60 is inserted into a bore 82 in handle half 16 (see FIG. 13). Bore 82 is not bored completely through the handle half, is thus a blind hole, and has a cylindrical diameter slightly greater than the cylindrical diameter of stop pin 60 at cylindrical surface 76. The opposite end of stop pin 60—that is, second end 72—is similarly inserted into and received in a bore 84 that is formed completely through handle half 18. Bore 84 is a cylindrical bore that has a diameter slightly greater than the cylindrical diameter of stop pin 60 at cylindrical surface 78 and, as detailed below, includes an axially stepped shelf having a smaller diameter than the rest of bore 84. Because the diameter of bores 82 and 84 is slightly greater than the diameter of stop pin 60 at the respective first and second ends, stop pin 60 may be axially rotated in the assembled knife 10 as described below. As also detailed below, the diameter of stop pin 60 at all points in central portion 74 is equal to or greater than the diameter of stop pin 60 measured from the axial centerline through the stop pin to cylindrical surfaces 76 and 78, respectively. Accordingly, when the knife 10 is assembled with first end 70 of stop pin 60 received in born 82, second end 72 of stop pin 60 received in bore 84, the stop pin is captured between handle halves 16 and 18 such that central portion 74 is located in slot 20 defined between the handle halves.

Figure 8:
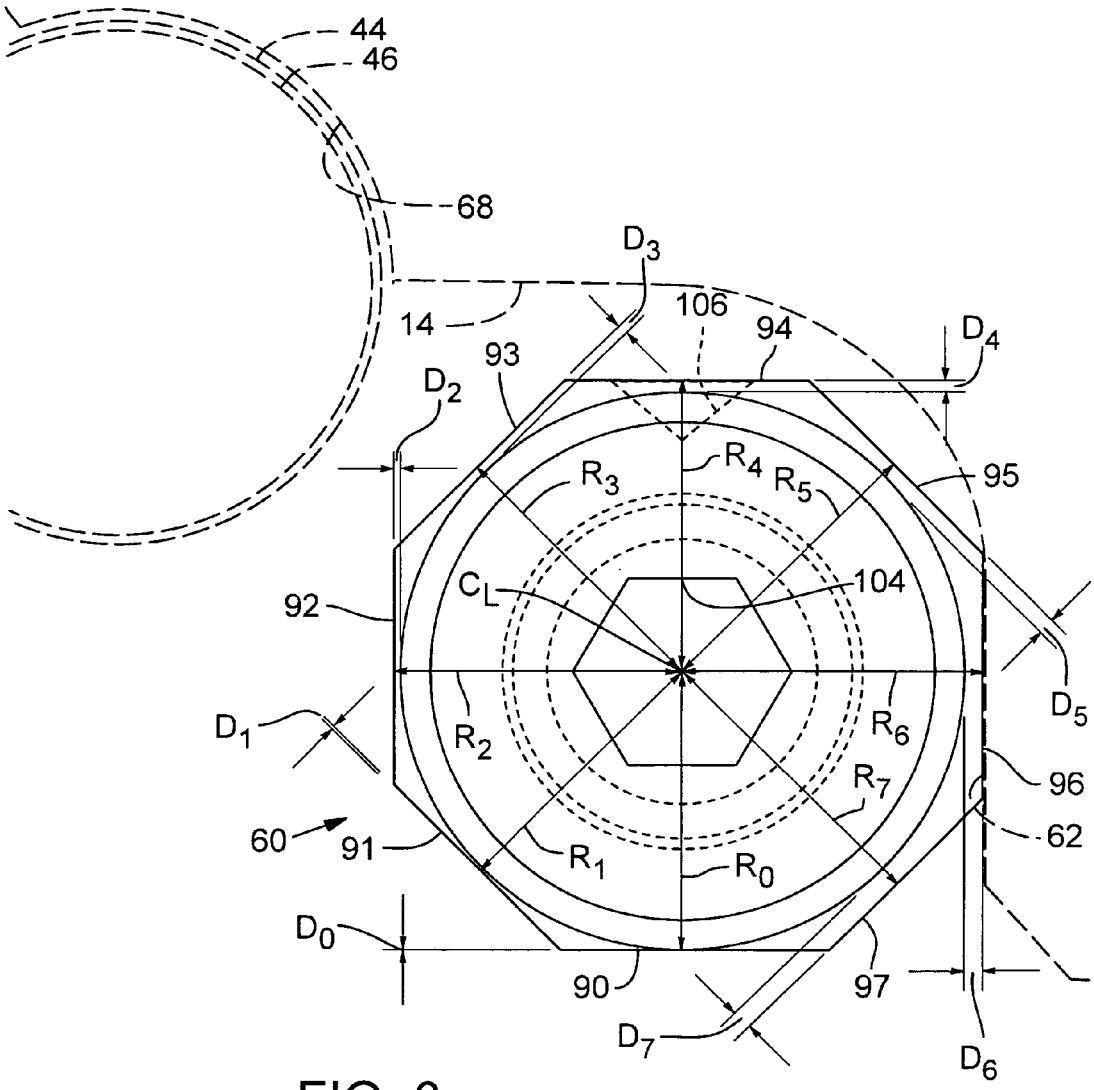
FIG. 8 is a close up, partially sectional view of the stop pin according to the present invention.

With reference now to FIGS. 6 and 8 through 12, the central portion 74 of stop pin 60 defines as noted a multi-faceted surface 80. In the embodiment illustrated herein, stop pin 60 comprises an octagonal cross section at central portion 74 that has 8 planar surfaces, identified in FIG. 8 with numbers 90, 91, 92, 93, 94, 95, 96, and 97. The radius of stop pin 60 measured from the axial centerline $C_L$ to the outer surfaces 90-97 of the stop pin is incrementally stepped from one adjacent surface to the next such that the radial distance increases incrementally from surface 90 to surface 97. Thus, the radius measured from $C_L$ to surface 90 is represented by dimension $R_0$. The radius measured from $C_L$ to surface 91 is represented by dimension $R_1$. The radius measured from $C_L$ to surface 92 is represented by dimension $R_2$, and so on. As noted, the radial distance increases incrementally from one adjacent surface to the next. As such, the radial distance $R_0<R_1<R_2<R_3<R_4<R_5<R_6<R_7$. The length of radius $R_0$ is the shortest radial length in central portion 74 and is preferably about the same radius as the radius of stop pin 60 measured at first end 70 and second end 72. That is, the radius of stop pin 60 measured from $C_L$ to surface 76 is preferably about equal to radius $R_0$, and the radius of stop pin 60 measured from $C_L$ to surface 78 is preferably about equal to radius $R_0$. Thus, the dimension represented by $D_0$ in FIG. 8 is about zero—dimension $D_0$ represents the difference between $R_0$ and the radius of stop pin 60 measured from $C_L$ to surface 78.

Moving in the clockwise direction in FIG. 8 from surface 90, the next adjacent surface 91 is a distance defined by radius $R_1$. Radius $R_1$ is incrementally greater than radius $R_0$ by the distance represented by dimension $D_1$. Thus, the dimension represented by $D_1$ in FIG. 8 is the difference between $R_1$ and the radius of stop pin 60 measured from $C_L$ to surface 78. Continuing in the clockwise direction, the next adjacent surface 92 is a distance defined by radius $R_2$. Radius $R_2$ is incrementally greater than radius $R_1$ by the distance represented by dimension $D_2$. The dimension represented by $D_2$ in FIG. 8 is the difference between $R_2$ and the radius of stop pin 60 measured from $C_L$ to surface 78. This incremental stepping continues around the stop pin 60. It will be appreciated therefore that $D_0<D_1<D_2<D_3<D_4<D_5<D_6<D_7$.

The actual incremental measurement from $D_0$ to $D_1$, $D_1$ to $D_2$ and so on may be varied according to the requirements of the particular tool in which the stop pin 60 is being used. Moreover, there is no need for the incremental measurement to be the same from one surface to the next. Nonetheless, in the illustrated embodiment the actual increment in each step (i.e., $D_0$, $D_1$, $D_2$, etc.) is preferably about 0.001 inch. In this embodiment, therefore, there is a difference of 0.007 inch between radius $R_0$ on the one hand, and radius $R_7$ on the other hand. As detailed below, this incrementally increasing radius of stop pin 60 allows the blade stop position to be adjusted in the assembled knife.

Figure 9:
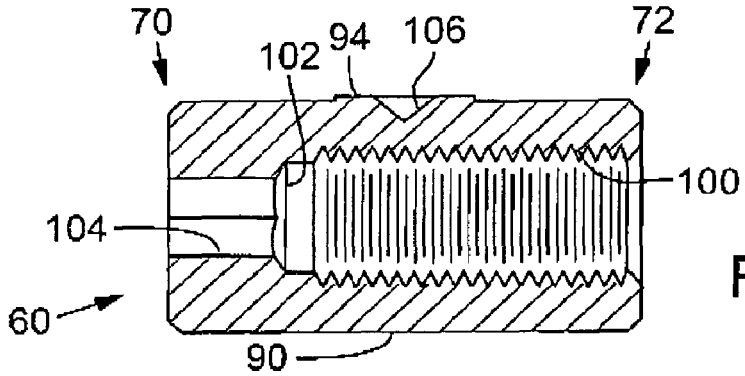
FIG. 9 is a longitudinal cross sectional view of the blade stop pin shown in FIG. 6, with the cross section taken along the line 9-9 of FIG. 12.
Figure 10:
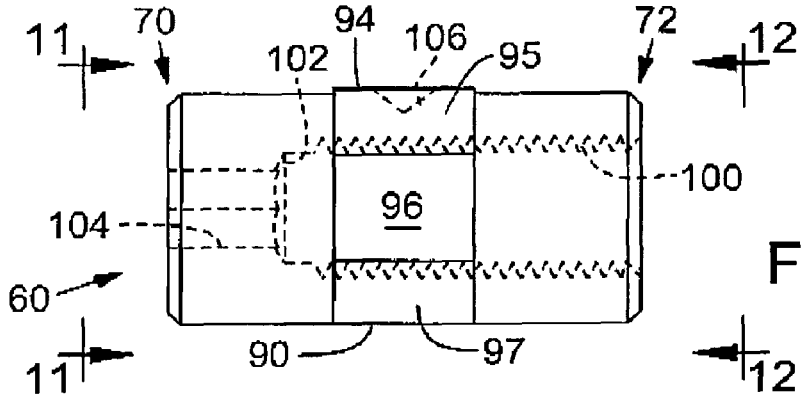
FIG. 10 is a side view of the blade stop pin shown in FIG. 9 showing the internal bores in phantom lines.
Figure 11:
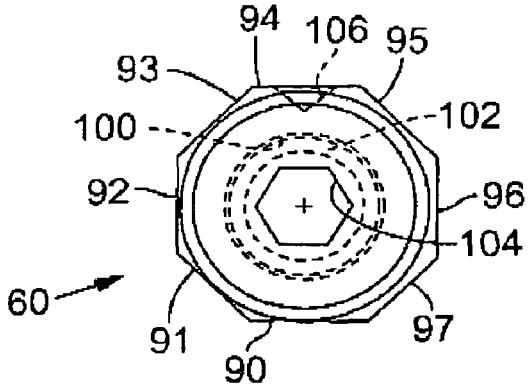
FIG. 11 an end view of the blade stop pin shown in FIG. 10, the view being taken from line 11-11 of FIG. 10.
Figure 12:
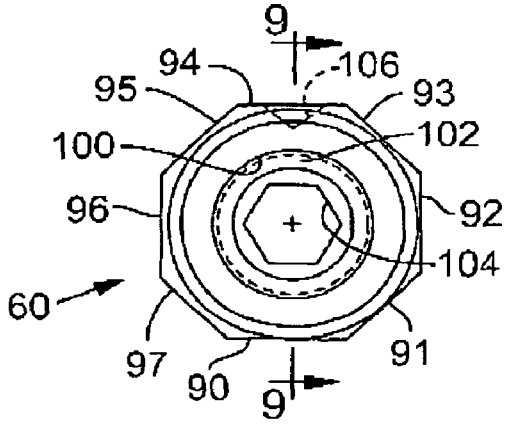
FIG. 12 is an end view of the blade stop pin shown in FIG. 10, the view being taken from line 12-12 of FIG. 10.

Turning to FIG. 9, stop pin 60 has an axially threaded bore 100 formed in second end 72. Threaded bore 100 terminates at an axial shelf 102 located intermediately along the length of the stop pin. A second axial bore 104 is formed through stop pin 60 extending from shelf 102 through first end 70. The diameter of second axial bore 104 is smaller than the diameter of threaded bore 100, and in the illustrated embodiment is hexagonal in cross section (FIG. 11) to allow rotational adjustment of the stop pin with a hex wrench inserted into threaded bore 100 and into bore 104, as detailed below. A reference notch 106 is formed in surface 94, which is the surface on central portion 74 of the stop pin that represents roughly the middle radial distance ($R_4$) between the minimal radial distance defined by $R_0$ and the maximal radial distance defined by $R_7$. As detailed below, reference notch 106 functions as a reference point or indicia that is used when adjusting the stop position of the implement.

Figure 13:
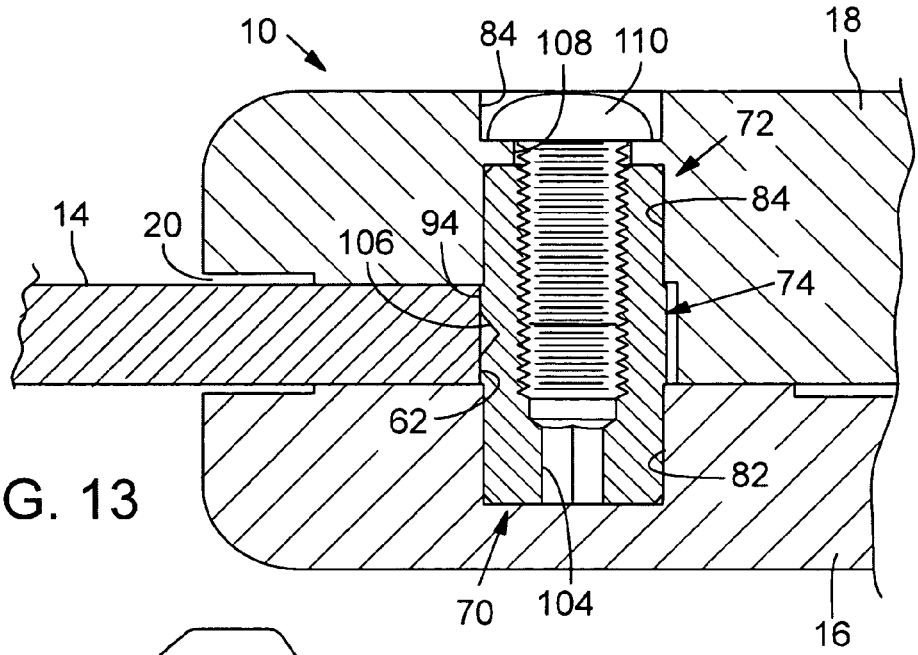
FIG. 13 is a partial sectional view taken along the line 13-13 of FIG. 14 and illustrating a relative position between the knife blade, the stop pin and the handle when the blade is in the open position.

Assembly of knife 10 and adjustment of the blade stop position using stop pin 60 will now be described. The components of knife 10 shown in FIG. 3, and any additional components such as safety mechanisms, are assembled to complete the knife as shown in FIG. 1. With reference to FIG. 13, during this assembly procedure the stop pin 60 is assembled as described above with first end 70 of the pin received in bore 82, and second end 72 received in bore 84. Bore 82 is a blind bore that does not extend completely through handle half 16, and as noted above, bore 84 includes an axial shelf 108 having a smaller diameter opening than bore 84. When the handle halves 16 and 18 are assembled in this manner and connected to one another (with appropriate screws and the like), bores 82 and 84 align to define a cylindrical bore that receives stop pin 60 with central portion 74 of the stop pin spanning the slot 20 in which blade 14 rotates, and with the stop pin captured in the bore between the end of bore 82 and the shelf 108. Knife 10 is initially assembled with stop pin 60 rotated in bores 82 and 84 such that surface 94 of stop pin 60, which as noted is marked with a reference notch 106, abuts shoulder 62 of blade 14 when the blade is in the open position. A screw 110 is then loosely threaded into threaded bore 100 in second end 72 of stop pin 60. The blade 14 is moved from the closed position to the open position in which shoulder 62 abuts surface 94 several times to rotate the stop pin so that the two planar surfaces of shoulder 62 and surface 94 are aligned. If the knife includes an automatic opener mechanism, the mechanism is fired several times to rotate the stop pin. The adjustment of the blade 14 and operation of the blade locking mechanism are then checked to ensure proper operation.

If the knife so assembled operates properly, screw 110 is tightened and optionally secured with a thread-locking compound. The screw may be easily tightened without stop pin 60 rotating in the knife because shoulder 62 of blade 14 is abutting surface 94 of stop pin 60, which acts as a wrench-like mechanism that prevents rotation of stop pin 60 as screw 110 is tightened.

If the knife so-assembled does not operate properly, for example, if the locking mechanism is out of adjustment, screw 110 is removed and a properly sized hex wrench is inserted into threaded bore 100 and into bore 104, which as noted is a hexagonally shaped bore. The blade 14 is then moved to the closed position and stop pin 60 is then axially rotated with the hex wrench to adjust the stop position of the blade 14. For example, by rotating stop pin such that surface 97 abuts shoulder 62 when blade 14 is in the open position, the rotational arc that the blade moves through from the closed position to the stop position will be shorter than the case where surface 94 abuts shoulder 62. Likewise, by rotating stop pin such that surface 90 abuts shoulder 62 when blade 14 is in the open position, the rotational arc that the blade moves through from the closed position to the stop position will be relatively longer than the case where surface 94 abuts shoulder 62. The blade is moved to the open position to rotate the stop pin so that the planar surface on the stop pin is aligned with shoulder 62, as described above. The knife adjustment is checked again. The stop pin 60 is rotated in this manner until the optimal blade stop position is found—that is, the stop position in which the blade locking mechanisms are correctly adjusted or the blade angle relative to the handle when the blade is in the open position is as desired. With stop pin 60 correctly adjusted and the blade 14 in the open, stopped position, the screw 110 is screwed into threaded bore 100 and is secured in place as already described.

As noted above, the incremental distance from one faceted surface to the next may be adjusted according to the needs and manufacturing tolerances of the tool with which the stop pin is being used. In the embodiment illustrated herein, as noted above, the radial distance increases by 0.001 inch with each successive surface (i.e., from surface 90 to surface 91 and so on). With a stop pin having these dimensions, the total adjustment afforded by the stop pin is 0.007 inch, which is adequate adjustment in many manufacturing instances.

Turning once again to FIGS. 5 and 8 in which blade 14 is in the fully open position, it may be seen that shoulder 62 on blade 14 is in abutting contact with surface 96 of stop pin 60. Because surface 96 and shoulder 62 are both planar surfaces, the area of contact between these two surfaces is greater than if the stop pin were cylindrical in cross section. This reduces the tendency of the blade to cause flattening of the stop pin through a peening action as the blade continually abuts the pin during repeated opening cycles, as would be the case if the stop pin were cylindrical in cross section. This thereby results in a stronger mechanism that maintains is adjustment.

Figure 14:
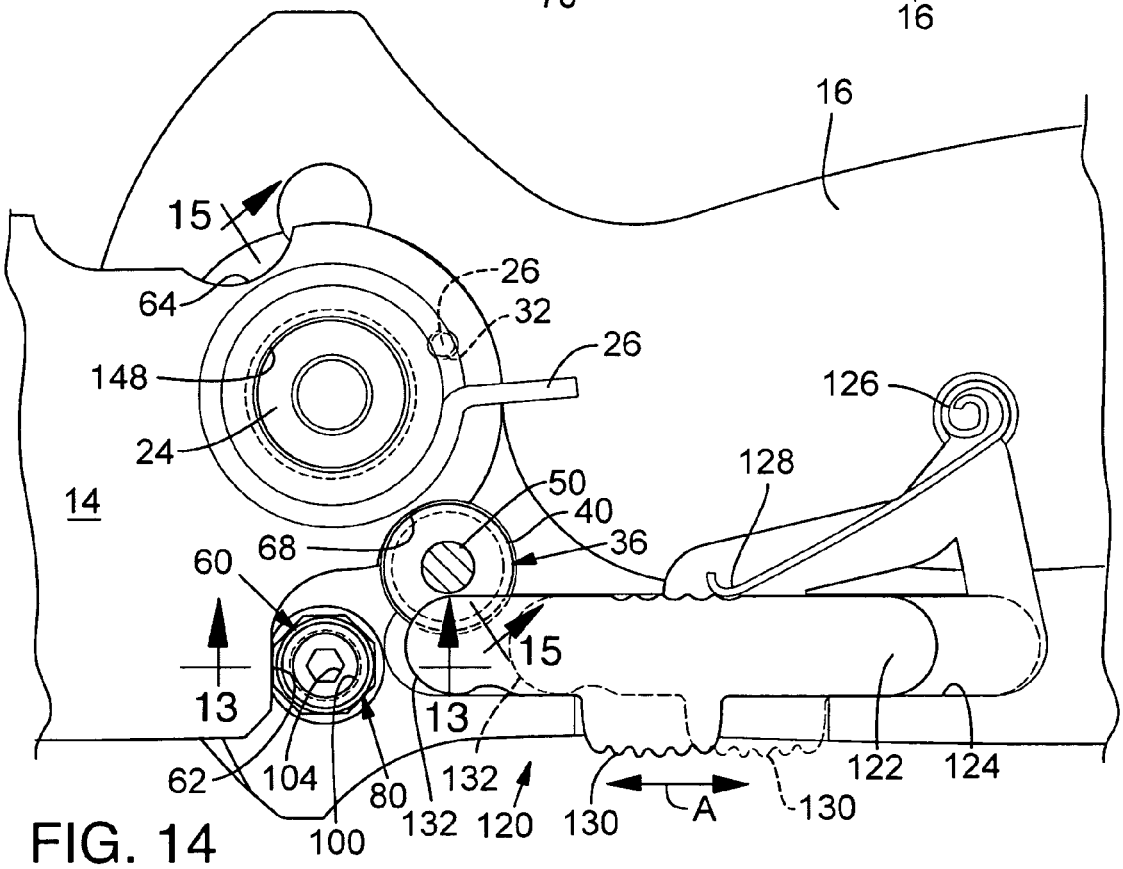
FIG. 14 is a partial sectional view of an alternative embodiment of a knife incorporating the stop pin according to the illustrated embodiment and also showing a safety mechanism used with the knife.

A knife incorporating a multi-faceted stop pin 60 in accordance with the illustrated embodiments described above is shown in FIGS. 14 and 15. However, the knife shown in FIGS. 14 and 15 includes a safety mechanism shown generally at 120 that is somewhat different from the safety mechanism described in the '866 patent. The safety mechanism 120 comprises a latch 122 that is housed in a cooperatively shaped cavity 124 formed in handle 18 and longitudinally slidable therein (as shown by arrow A in FIG. 14). A spring 126 also is housed in cavity 124 and has a resilient spring arm member 128 that biases against latch 122. Safety mechanism 120 is operable with an exposed thumb lug 130 and functions to prevent operation of cross bolt 36. Thus, when the blade 14 is in the closed position, the forward end 132 of latch 122 projects toward shank 50 on cross bolt 36 such that the forward end 132 interferes with movement of the cross bolt. This is the latched or "on" position for safety mechanism 120. As may be seen in FIG. 15, if button 38 of cross bolt 36 is depressed when latch 122 is in the forward, latched position, forward end 132 abuts against flange 40, thereby preventing disengagement of the locking end 42 from the blade. If latch 122 is slid in the rearward direction (that is, the direction toward the butt end of knife 10 as shown in phantom lines in FIG. 14), the trigger 34 may be depressed without interference from the latch and against the biasing force of spring 134 applied to cross bolt 36. This causes the locking end 42 to disengage from blade 14 and thereby allows the blade to either open (automatically, under the force of spring 26) or to be closed (against the force of spring 26).

Figure 15:
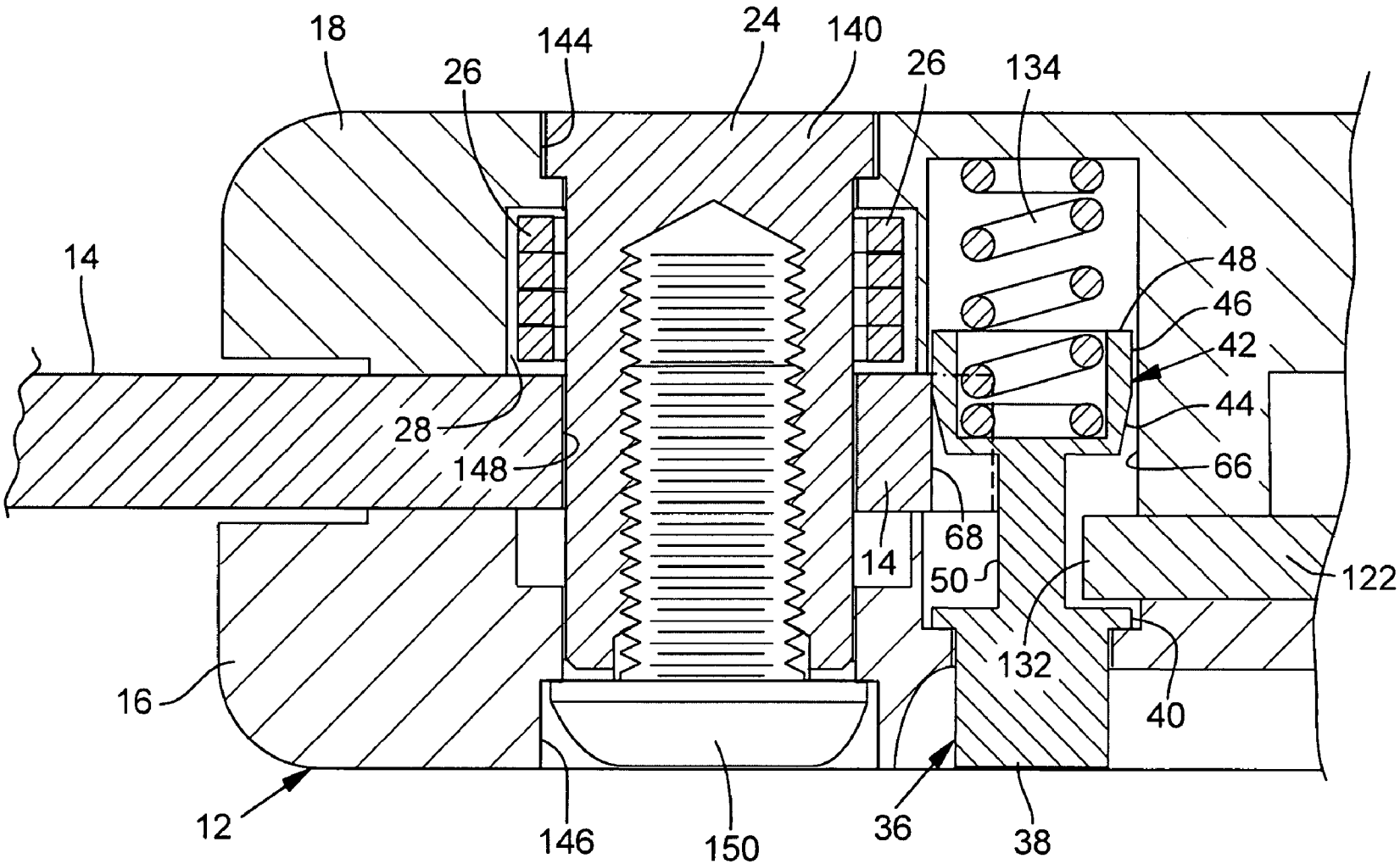
FIG. 15 is a sectional view taken along the line 15-15 of FIG. 14.

FIG. 15 illustrates in detail some aspects of the safety mechanism 120, the trigger 34 and the pivotal attachment of blade 14 to the handle 12. Referring to pivot shaft 24, it may be seen that the shaft is defined by an outer sleeve 140 that has one end that is preferably press fit into bore 144 and the opposite end locationally fit in a corresponding bore 146. The shaft extends through a bore 148 formed in the tang portion of blade 14. A bolt 150 threads into an internal bore in sleeve 140 to retain the pivot shaft 24 in position. The latch 122 of safety mechanism 120 in FIG. 15 is shown in the forward, on position, and as such, trigger 34 is rendered inoperable and the blade is locked in the open position with locking end 42.

Those of ordinary skill in the art will readily appreciate that the multifaceted stop pin described herein may be used with any knife that utilizes a stop pin, regardless of whether the knife also uses a locking mechanism, or an automatic opening mechanism. Moreover, there are numerous equivalent modifications to the stop pin that may be made without departing from the scope of the invention. In addition to the equivalent modifications described above, a stop pin according to the present invention may be fabricated with an elliptical cross sectional shape in the central portion 74 of the pin, rather than the multifaceted surfaces described above. As with the multi-planar embodiment described above, an elliptically shaped stop pin essentially defines a multifaceted outer surface that allows for variable adjustment of the stop position of the blade. Furthermore, it will be appreciated that while in the illustrated embodiment bore 104 is shown as being hexagonal, any bore having a cross sectional shape that facilitated insertion of a tool that engages the bore and thus allowed for axial rotation of the stop pin would be equivalent and serve the same function. Thus, for example, any polygonal bore or even an elliptical bore would be equivalent to the hexagonal bore 104.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. In a folding tool having an elongate body and an implement, wherein the body includes two opposed sidewalls held in a spaced apart relationship defining a slot therebetween, the implement is rotatably attached to the body and is rotatable from a first position in which the implement is at least partially received in the slot and a second position in which the implement is at least partially rotated out of the slot for use, the improvement comprising:

an elongate stop pin having a longitudinal axis, first end and a second end, a first cylindrical outer surface adjacent the first end, a second cylindrical outer surface adjacent the second end, and a central portion between said first and second cylindrical outer surfaces, said central portion defined by a plurality of planar surfaces parallel to the longitudinal axis, a first axial bore in the first end having a first diameter, said first axial bore extending partially along the length of the stop pin and terminating at a shelf, and a second axial bore extending from said shelf at least partially toward said second end, said second axial bore having a smaller diameter than said first axial bore;

whereby said first cylindrical portion is rotatably received in a first cylindrical bore extending partially through the first sidewall and said second cylindrical portion is rotatably received in a second cylindrical bore in the opposite sidewall such that the central portion lies in the slot, the first sidewall having a hole extending therethrough into the first cylindrical bore and aligned with said first axial bore in the stop pin; and wherein the shortest radial distance from the longitudinal axis to each of the plurality of planar surfaces is different for each planar surface.

2. The folding tool according to claim 1 wherein the first axial bore in the stop pin is threaded and the hole in the first sidewall has a diameter that is smaller than the diameter of the first cylindrical bore in the first sidewall and wherein the stop pin is fixed relative to the first sidewall to prevent axial rotation of said stop pin with a screw inserted through the hole and threaded into the first axial bore.

3. The folding tool according to claim 1, wherein the shortest radial distance from the axis to a first planar surface is equal to the radial distance from the axis to the first cylindrical outer surface.

4. The folding tool according to claim 3 wherein the shortest radial distance from the axis to the planar surface adjacent the first planar surface is greater than the shortest radial distance from the axis to the first cylindrical outer surface.

5. The folding tool according to claim 1 including N planar surfaces P in the central portion, represented by $P_0$, $P_1$, $P_2$. . . $P_N$, and wherein the shortest radial distance from the axis to each of the N planar surfaces is different for each such surface.

6. The folding tool according to claim 5 wherein the shortest radial distance from the axis to a planar surface is represented by R so that for each of the planar surfaces P there is a corresponding distance R, and wherein $R_0<R_1<R_2 \ldots <R_N$.

7. The folding tool according to claim 5 wherein one of the planar surfaces defines a reference surface and includes a reference indicia.

8. The folding tool according to claim 1 wherein the second axial bore is defined by a hexagonal opening.

* * * * *